US006717350B2

(12) United States Patent
Yonezawa et al.

(10) Patent No.: US 6,717,350 B2
(45) Date of Patent: Apr. 6, 2004

(54) ELECTRON TUBE AND METHOD OF MANUFACTURING THE SAME

(75) Inventors: Yoshihisa Yonezawa, Mobara (JP); Yukio Ogawa, Mobara (JP); Yasuhiro Nohara, Mobara (JP); Hiroaki Kawasaki, Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 10/085,057

(22) Filed: Mar. 1, 2002

(65) Prior Publication Data

US 2002/0121857 A1 Sep. 5, 2002

(30) Foreign Application Priority Data

Mar. 2, 2001 (JP) ..... 2001-059185

(51) Int. Cl.[7] ..... H01J 1/90
(52) U.S. Cl. ..... 313/495; 313/272; 445/46
(58) Field of Search ..... 313/495, 238, 313/271, 272, 273, 292; 445/35, 43, 44, 46, 52

(56) References Cited

U.S. PATENT DOCUMENTS 3,784,862 A * 1/1974 Yoshitoshi et al. ..... 313/562
3,906,277 A * 9/1975 Schade ..... 313/365
4,263,700 A * 4/1981 Fujisaki et al. ..... 445/25
5,667,418 A * 9/1997 Fahlen et al. ..... 445/25

FOREIGN PATENT DOCUMENTS

| | | | |
|---|---|---|---|
| DE | 27-43-423 A1 | * | 4/1979 |
| GB | 2074370 A | * | 10/1981 |
| JP | 4-324236 | * | 11/1992 |
| JP | 6-88043 | | 12/1994 |

* cited by examiner

*Primary Examiner*—Don Wong
*Assistant Examiner*—Thuy Vinh Tran
(74) *Attorney, Agent, or Firm*—Oblon, Spivak, McClelland, Maier & Neustadt, P.C.

(57) ABSTRACT

An electron tube such as a fluorescent display tube is provided. Auxiliary linear support members (e.g. linear spacers and linear dampers), which subsidiarily support liner members (e.g. cathode filaments and wire grids), are bonded on a substrate, using ultrasonic welding (without using an adhesive agent (e.g. fritted glass or a conductive paste)). A metal layer (e.g. a thin or thick aluminum film) is formed over the glass substrate. The end of the coil of a cathode filament is securely bonded to the metal layer. A spacer of a metal wire (e.g. aluminum) is ultrasonic welded to the metal layer. The welding is performed with the wedge tool of an ultrasonic welder placed at the position where the spacer is in contact with the cathode filament. A U-shaped recess is left at the welded spot. This recess prevents the cathode filament from being displaced. If necessary, the metal layer is formed over the substrate and the damper of a metal wire (e.g. aluminum) is disposed to prevent the vibration of the cathode filament.

24 Claims, 13 Drawing Sheets

ELECTRON TUBE AND METHOD OF MANUFACTURING THE SAME

FIELD OF THE INVENTION

BACKGROUND OF THE INVENTION

The present invention relates to an electron tube which includes cathode linear members (e.g. cathode filaments), linear members (e.g. wire grids), getter linear members, and support auxiliary members (e.g. linear spacers and linear dampers), and to a method of manufacturing the same.

DISCUSSION OF THE INVENTION

A fluorescent luminous tube, being one of conventional electron tubes, will be explained below by referring to FIGS. 12 and 13.

FIG. 12(*a*) is a plan view illustrating a glass substrate on which cathode filaments, a linear spacer, a linear damper, and others are mounted. FIG. 12(*b*) is a cross-sectional view of the portion taken along the line X1–X2 in FIG. 12(*a*). FIG. 12(*c*) shows another example of the structure in FIG. 12(*b*).

Referring first to Figs. 12(*a*) and 12(*b*), numeral 91 represents a glass substrate; 93 represents a cathode filament being a linear member; 951 represents a spacer (an auxiliary linear member) for supporting the filament 91; and 952 represents a damper (an auxiliary linear member) for supporting the filament 93.

One end of the filament 93 with the coil 931 is welded, together with the metal piece 921, to a metal layer 92 (acting as a cathode mounting electrode), vapor-deposited on the substrate 91. Using the linear (or rod-like) insulating (or glass) spacer 951, a filament 93 is suspended so as to be elevated by a predetermined interval from the anode 96 (e.g. an anode electrode) on which a fluorescent substance is coated. To prevent the filament 93 from being contacted with the anode 96 due to vibration, a damper 952 (of the same material as the spacer 951) is disposed on the substrate 91. The spacer 951 and the damper 952 are directly bonded to the substrate 952 or are adhered to the insulating layer of the substrate 91 using an adhesive agent (e.g. fritted glass).

Referring to FIG. 12(*c*), a conductive spacer 951 is securely adhered to the metal layer 941 bonded on the substrate 91, using a conductive paste. Some spacers 951 are formed of a conductive material entirely or of an insulating material (e.g. glass) coated with a conductive material.

FIG. 13 shows an example of a grid formed of a metal wire, that is, the so-called wire grid. FIG. 13(*a*) is a plan view partially illustrating a glass substrate on which a wire grid is mounted. FIG. 13(*b*) is a cross-sectional view partially illustrating the portion taken along the line X2—X2 of FIG. 13(*a*). Like reference numerals are attached to the same constituent elements as those in FIG. 12.

Referring to Fig. 13, numeral 97 represents a wire grid being a linear member; 953 represents a spacer being an auxiliary linear support member of the wire grid 97; and 954 represents a damper being an auxiliary linear support member of the wire grid 97.

The wire grid 97 is suspended between a cathode filament 93 and an anode 96 in the direction perpendicular to the filament 93. The linear (or rod-like) spacer 953 of an insulating material (e.g. glass) holds the wire grid 97 at a predetermined elevation. One end of the wire grid 97 is securely bonded using the substrate 91 and the side plate 912. In order to prevent the wire grid 97 from being contacted with the anode 96 due to vibration, the damper 954 of the same material as the spacer 953 is mounted on the substrate 91. The spacer 953 and the damper 954 are directly bonded to the substrate 91 or are adhered to an insulating layer overlying the substrate 91 using an adhesive agent (e.g. fritted glass).

Conventionally, an adhesive agent (e.g. fritted glass or an adhesive paste) has been used to securely bond the auxiliary liner support members (e.g. spacers and dampers). However, the problem is that gas is generated from the adhesive agent inside an electron tube (such as a fluorescent display), thus decreasing the vacuum degree therein.

In order to mount and bond the spacer or damper on a base (or a substrate), an adhesive agent such as fritted glass is heated, softened, cooled and solidified. However, when the adhesive agent is re-heated and softened in the post step, the spacer or damper is often separated or displaced. For that reason, a suitable adhesive agent has to be chosen in consideration of the steps after bonding spacers and dampers. The temperature after the bonding has to be controlled carefully. Hence, the step of mounting spacers and dampers is troublesome and leads to high manufacturing costs. The substrate, the adhesive agent, the spacer, and the damper are required to have the same thermal expansion coefficient. The choice of such materials is limited.

The conventional linear or rod-like spacer, which has a smooth surface, often causes displacement of a liner member (such as a cathode filament or a wire grid). To prevent the displacement, some spacers have a recessed formed on the surface thereof and a filament or a wire grid is disposed in the recessed. However, this approach leads to an increase of the fabrication costs of a spacer.

SUMMARY OF THE INVENTION

The present invention is made to solve the above-mentioned problems.

An object of the invention is to provide an electron tube wherein auxiliary support members (e.g. spacers and dampers) used to subsidiarily support liner members (e.g. cathode filaments and wire grids) are bonded to a substrate, without using an adhesive agent. This structure can reduce the generation of gas causing a decrease in vacuum degree and simplify the process of mounting the auxiliary support member.

Particularly, the ultrasonic welding (ultrasonic bonding or ultrasonic wire bonding) can be preferably performed to heat a local area, that is, only the contact surface (interface) between the metal layer and the auxiliary metal support.

The objective of the present invention is achieved by an electron tube comprising a hermetic container having a first substrate on which an anode is formed and a second substrate confronting the first substrate; a metal layer formed inside the hermetic container; a linear member disposed in the hermetic container so as to confront the metal layer; at least one set of holders, disposed in the hermetic container, for holding the linear member; and metal auxiliary members, disposed between the linear member and the metal layer, each for supporting a linear member welded to the metal layer.

In the electron tube, the linear member comprises a cathode filament. Each of said auxiliary members comprises a spacer for a cathode filament. At least one set of the spacers is disposed between (inside) the holders.

In the electron tube, the linear member comprises a cathode filament. Each of the auxiliary members comprises a spacer for a cathode filament. The metal layer comprises a cathode mounting electrode.

In the electron tube, the linear member comprises a cathode filament. Each of the auxiliary members comprises a damper for a cathode filament. The damper is disposed between (inside) the holders.

In the electron tube, the linear member comprises a cathode filament. The auxiliary members comprise a spacer and a damper, for a cathode filament. At least one set of spacers is disposed between (inside) the holders. At least one damper is disposed between (inside) the spacers.

In the electron tube, the linear member comprises a wire grid. Each of the auxiliary members comprises a spacer for the wire grid. At least one set of spacers is disposed between (inside) the holders.

In the electron tube, the linear member comprises a grid wire. Each of the auxiliary members comprises a damper for the wire grid. The damper is disposed between (inside) the holders.

In the electron tube, the auxiliary members are disposed independently for each linear member.

In the electron tube, the welding is ultrasonic welding.

In the electron tube, the metal layer and the auxiliary members are made of the same metal material.

In the electron tube, the metal layer comprises a thin film layer.

In the electron tube, the linear member has partially or wholly a spring for providing tension.

In the electron tube, the linear member comprises a linear spacer or a linear damper or a linear getter.

In the electron tube, the each of auxiliary members has a recessed or a protrusion at a position where each auxiliary member confronts a linear member.

In the electron tube, the electron tube is a fluorescent luminous tube.

According to another aspect of the present invention, a method of manufacturing an electron tube having a hermetic container containing a first substrate and a second substrate confronting said first substrate, comprising the steps of forming a metal layer inside the hermetic container; bonding a metal auxiliary member for linear member support to the metal layer, through ultrasonic welding; and disposing a linear member so as to confront the auxiliary member.

The electron tube manufacturing method further comprises the steps of forming an electrode on the substrate; and simultaneously forming the metal layer in the step, together with the electrode.

In the electron tube manufacturing method, the electrode comprises an anode electrode. The step is the step of manufacturing an anode electrode.

In the electron tube manufacturing method, the cathode comprises a cathode mounting electrode. The step is the step of manufacturing a cathode mounting electrode.

In the electron tube manufacturing method, the electron tube comprises a fluorescent luminous tube.

BRIEF DESCRIPTION OF THE DRAWINGS

This and other objects, features, and advantages of the present invention will become more apparent upon a reading of the following detailed description and drawings, in which.

DETAILED DESCRIPTION OF THE PREFERRED EMBODIMENTS

Embodiments of the present invention will be described below with reference to the attached drawings.

A fluorescent display tube, being one of electron tubes, according to a first embodiment of the present invention will be described below by referring to FIGS. 1, 2 and 3.

Figure 1A:
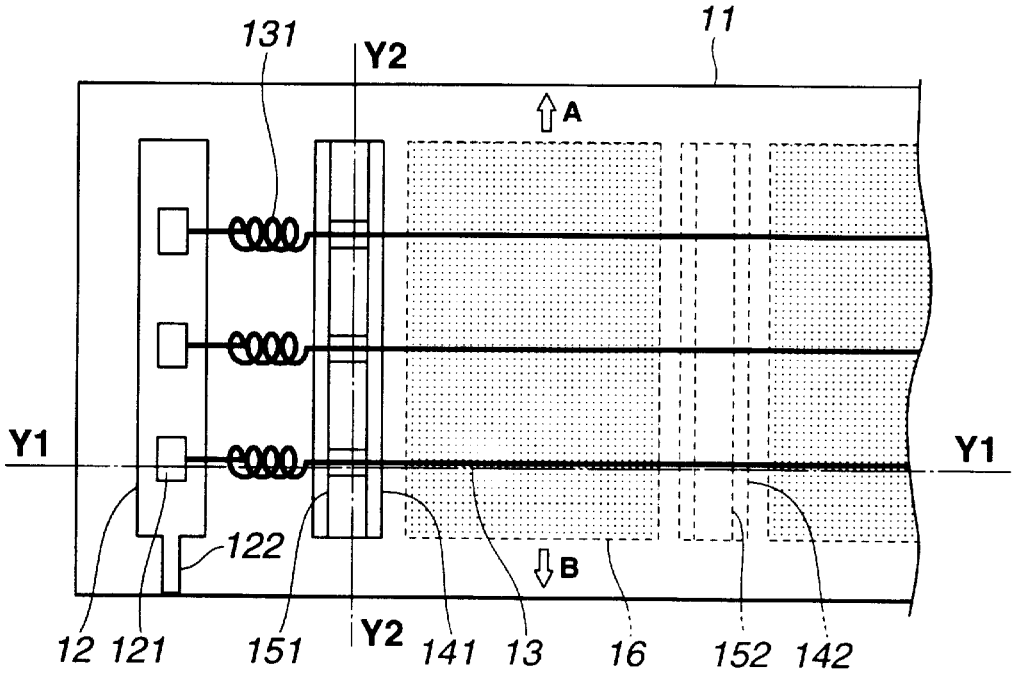
FIG. 1(*a*) is a plan view partially illustrating a fluorescent display tube according to a first embodiment of the present invention and FIGS. 1(*b*) and 1(*c*) are cross-sectional views each illustrating the same.
Figure 1B:
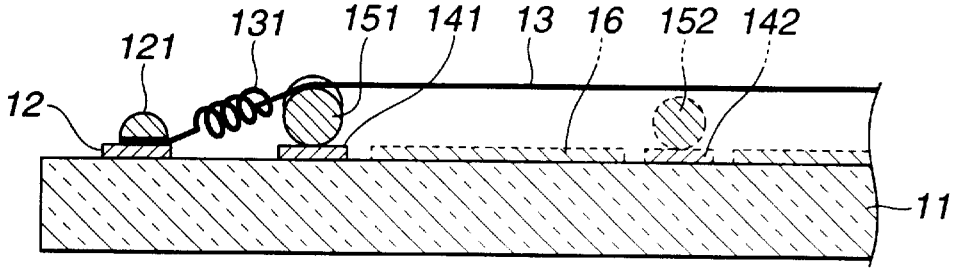
Figure 1C:
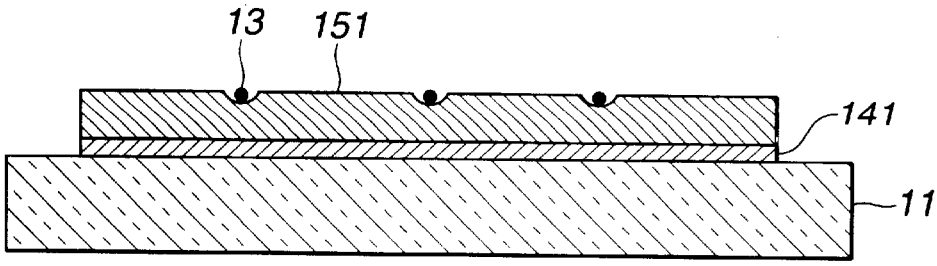

FIG. 1(*a*) is a plan view illustrating a glass substrate on which cathode filaments, linear spacers, and liner dampers are mounted. FIG. 1(*b*) is a cross-sectional view partially illustrating the portion taken along the line Y1—Y1 of FIG. 1(*a*). FIG. 1(*c*) is a cross-sectional view illustrating the portion taken along the line Y2—Y2 of FIG. 1(*a*).

Referring to FIG. 1, reference numeral 11 represents an insulating substrate (e.g. glass) being a base; 13 represents a cathode filament (e.g. W or Re—W alloy) being a liner member; 12 represents a cathode mounting electrode; 122 represents a cathode wire acting as a power feeding point, which is connected to the cathode mounting electrode 12 and led out from the fluorescent display tube; 151 represents a spacer (of a metal such as aluminum) being an auxiliary support member of the filament 13; and 152 represents a damper (of a metal such as aluminum) being an auxiliary support member of the filament 13. A filament 13 has a coil 131 having a resilient property at the end thereof. The coil 131 provides a predetermined tension to the filament 13.

One end of the coil 131 of a filament 13 is mounted to the metal layer 12 (of a metal such as aluminum) for a cathode electrode coated on the substrate 11, together with a metal piece 121 (e.g. aluminum). A linear (or rod-like or fine-line-like) spacer 161 of a metal (e.g. aluminum) suspends the filament 13 so as to elevate it by a predetermined distance from the anode 16 (e.g. an anode electrode), on which a fluorescent substance (e.g. ZnO:Zn) is coated. To prevent a short circuit of a filament 13 and other electron-tube forming component (e.g. the anode 16) due to vibration, or a damage of the other component by the filament 13, the damper 152 of the same materials as that of the spacer 151 is mounted if necessary. A spacer 151 is ultrasonic welded to the metal layer 141 (e.g. an aluminum thin film) deposited on the substrate 11. A damper 152 is ultrasonic welded to the metal layer 142 (e.g. an aluminum thin film) deposited on the substrate 11. The metal layer 121 (e.g. aluminum) may be securely fixed to the metal layer 12 by ultrasonic welding.

The spacer means a member, being in contact (or engagement) with a linear member, for defining the elevation (height) of the linear member spaced from a substrate.

The damper means a member, being in contact with or in no contact with a linear member, for preventing the linear member from contacting with a substrate or an electron tube forming component because of vibration.

The spacer 151 is first placed on the metal layer 141. The wedge tool of an ultrasonic welder is pressed against the spacer 151 at the position where the filament 13 contacts with the spacer 151. Thus, the spacer 151 and the metal layer 141 are ultrasonic-bonded together using the wedge tool. In this welding, a recess in agreement with the shape of the inner surface of the wedge tool is impressed in the surface of the spacer 151. In this case, a U-shaped recess is formed as shown in FIG. 1(*c*). The filament 13 suspended in the recess does not cause its displacement. The ends of the spacer 151 may be merely welded to the metal layer 141. However, in order to prevent the displacement of the filament 13, the ends of the spacer 151 and the spots at the positions where filaments 13 are in contact with the spacer 151 are preferably bonded.

In a manner similar to that to the spacer 151, the damper 152 is securely bonded by the ultrasonic welding. However, to reduce the heat dissipation of the filament 13 at the portion where the damper 152 contacts with the filament 13, the diameter of the damper 152 is normally set in such a way that the filament 13 (in vibration) does not contact with the damper 152. This eliminates the recess accepting the filament 13. Consequently, the ends of the damper 152 are merely welded to the metal layer 142.

In this embodiment, an aluminum wire of a diameter of 0.1 mm to 1.0 mm is used for the spacer 151. An aluminum wire of a diameter of 0.05 mm to 0.8 mm is used for the damper 152. In welding, the spacer 151 has a recess having a width of 0.1 mm to 1.0 mm and a depth of 0.05 to 0.5 mm. An aluminum wire of a diameter of 0.1 mm to 1.0 mm is used for the metal piece 121. In welding, the metal piece 121 has a depth corresponding to about ⅓ of its diameter. The metal piece 121 may be formed of a square aluminum wire having a cross section in which one side is 0.1 mm to 1.0 mm.

In the ultrasonic bonding between the spacer 151 and the metal layer 141 or between the damper 152 and the metal layer 142, the ultrasonic frequency is 38 KHz; the power output is 200 W; the applied pressure is 11 N when the contact area is 0.25 $mm^2$, 21 N when the contact area is 1 $mm^2$, and 31 N when the contact area is 4 $mm^2$; the applied time is 0.3 seconds; and the amplitude is 70V. As a concrete example, the applied pressure is 15 N or more when the contact area is 0.25 $mm^2$, 23 N or more when the contact area is 1 $mm^2$, or 35 N or more when the contact area is 4 $mm^2$.

In this embodiment, because the ultrasonic bonding can be applied to bond auxiliary support members such as dampers and spacers, it can be prevented that the metal layer is completely vaporized by heating. This enables using a thin film metal layer so that the use amount of aluminum can be decreased.

Auxiliary support members mounted on the anode substrate can be formed in the same step, together with an anode electrode on which a fluorescent substance layer is coated and/or an anode wire. Hence, the structure facilitates the device fabrication.

Moreover, auxiliary support members can be formed on the cathode substrate (or a substrate on which a cathode such as a cathode filament is formed so as to confront the anode substrate) in the same step, together with a cathode electrode and/or a cathode wire. Hence, the structure facilitates the device fabrication.

Moreover, auxiliary support members can be formed on both the cathode substrate and the anode substrate, in accordance with the above-mentioned steps. Hence, the structure facilitates the device fabrication.

By connecting the metal layer 141 to the metal layer 12 or the cathode wire 122 for a cathode mounting electrode, the spacer 151 (metal) can be used as a power feeder for the filament 13. In such a structure, no current flows through the coil 131 of the filament 13, so that the coil 131 is not heated. Consequently, because the electron emitter such as carbonate coated over the coil 131 is not vaporized through heating of the coil 131, the fluorescent substance is not contaminated while the spring property of the coil 131 is not deteriorated. This feature can eliminate the power wastefully consumed by the coil 131 and can prevent the coil 131 heated in red from disturbing clear displaying.

In this embodiment, the spacer 151 and the damper 152 are securely fixed without using an adhesive agent such as a fritted glass or a conductive paste. Hence, the components are not separated off or displaced in the post baking step. Moreover, gas, which decreases the vacuum degree, does not generate in an electron tube such as a fluorescent display tube. Because a recess for preventing displacement of a filament is formed upon the welding, it is not required to use a spacer 151 with a recess previously machined.

To improve the selectivity of the anode 16, a mesh or plan grid may be disposed between the filament 13 and the anode 16.

An insulating layer may be further added to the structure of FIG. 1. Such a structure will be explained below.

Anode wires are brined on the anode substrate 11. An insulating layer is formed over the anode substrate 11 and the anode wires. The insulating layer has through holes formed corresponding to predetermined portions of an anode wire. The insulating layer, being a $SiO_x$, or SiN thin film, is formed through the screen printing or vapor deposition. An anode electrode is formed above the through holes. Each anode electrode is connected to an anode wire via the through holes. The through holes may be filled with a metal. A fluorescent substance layer (a luminous dot) is coated on the anode electrode. Metal layers 141 and 142 are deposited over the insulating layer. The spacer 151 may be ultrasonic welded to the metal layer 142 while the damper 152 may be ultrasonic welded to the metal layer 142.

That is, the metal layer formed over the substrate includes the metal layer formed over another constituent member (insulating layer) overlying the substrate. In other words, the metal layer formed on the substrates includes the metal layer supported by the substrate.

Figure 2A:
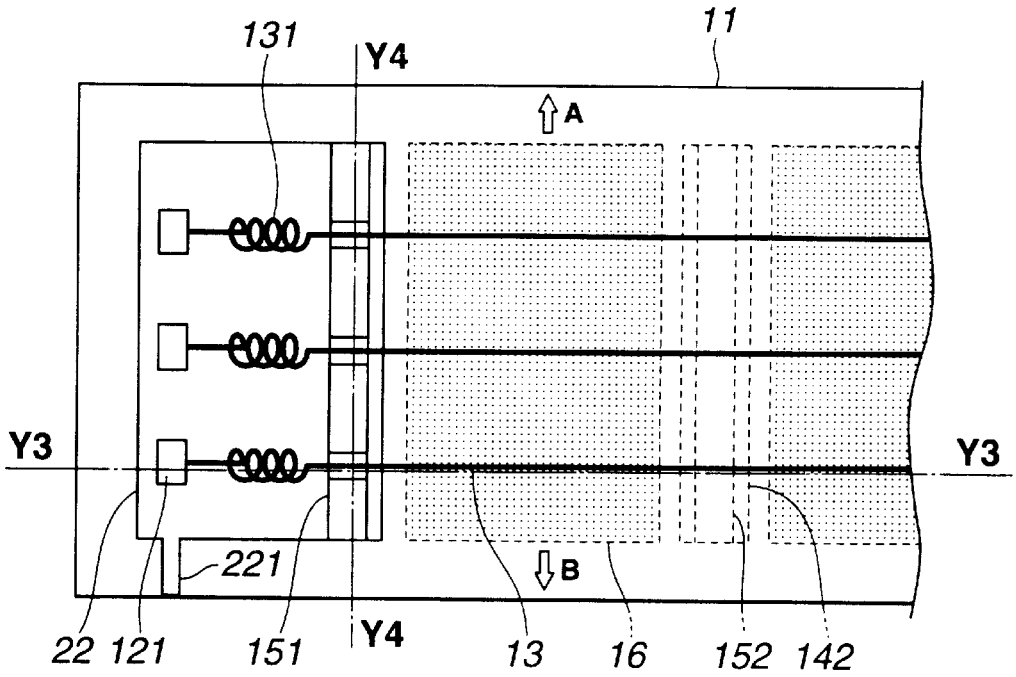
FIG. 2(*a*) is a plan view partially illustrating a modification of the fluorescent display tube of FIG. 1 and FIGS. 2(*b*) and 2(*c*) are cross-sectional views each illustrating the same.
Figure 2B:
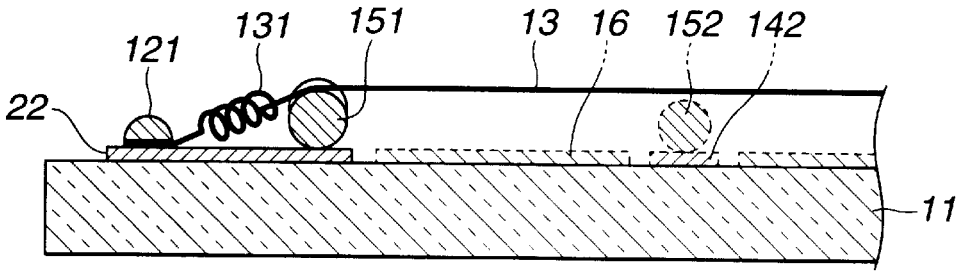
Figure 2C:
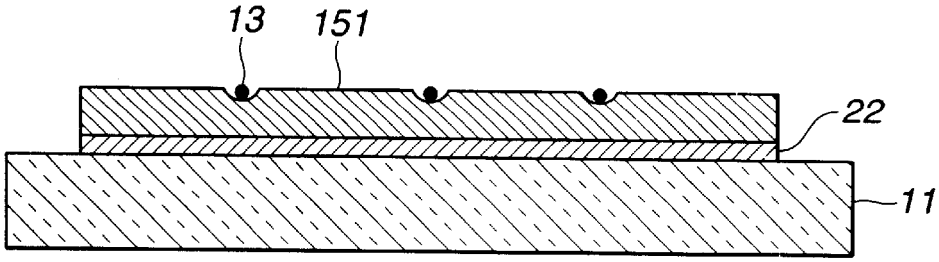

FIG. 2 shows a modification of the metal layer 141 in FIG. 1. Like numerals are attached to the same constituent elements as those in FIG. 1. FIG. 2(*b*) is a cross-sectional view illustrating the portion taken along the line Y3—Y3 of FIG. 2(*a*). FIG. 2(*c*) is a cross-sectional view illustrating the portion taken along the line Y4—Y4 of FIG. 2(*a*).

Referring to FIG. 2(*a*), the metal piece 121 is bonded to the metal layer 22 (such as an aluminum thin film for a cathode mounting electrode), together with one end of the filament 13. That is, the metal layer 22 is bonded together with the filament 13 and the spacer 151. Referring to FIG. 2, the filament 13 power-supplied via the spacer 151 does not cause the heating of the coil 121, explained with FIG. 1. Numeral 221 represents a cathode wire.

Figure 3A:
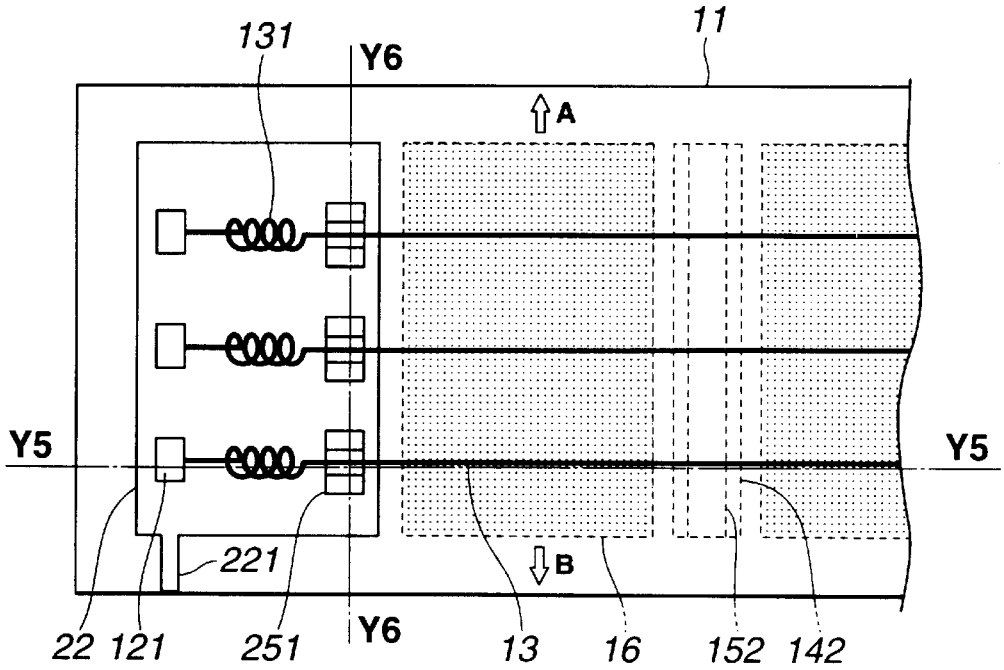
FIG. 3(*a*) is a plan view illustrating another modification of the fluorescent display tube of FIG. 1 and FIGS. 3(*b*) and 3(*c*) are cross-sectional views each illustrating the same.
Figure 3B:
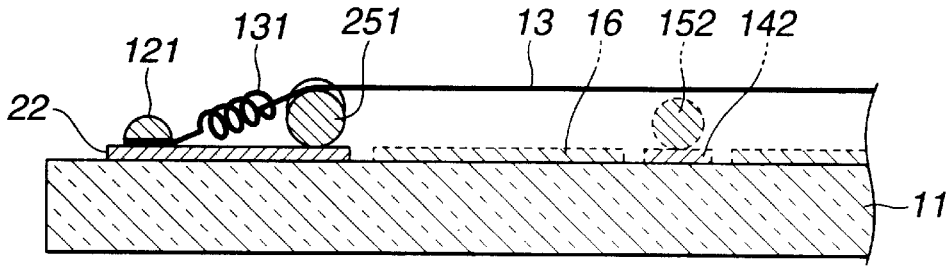
Figure 3C:
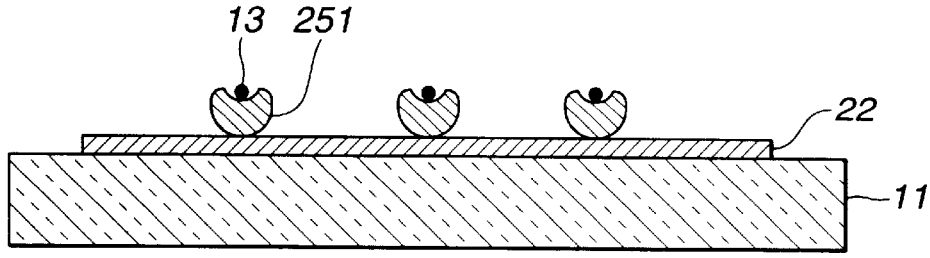

FIG. 3 shows a modification of the spacer 151, being an auxiliary support member, of FIGS. 1 and 2. Like reference numerals are attached to the same constituent elements as those of FIGS. 1 and 2. FIG. 3(*b*) is a cross-sectional view illustrating the portion taken along the line Y5–Y54 of FIG. 3(*a*). FIG. 3(*c*) is a cross-sectional view illustrating the portion taken along the line Y6—Y6 of FIG. 3(*a*).

Referring to FIG. 3, a spacer 251 is an auxiliary support member disposed for each filament 13. As shown in FIG. 3(*c*), the wedge tool of an ultrasonic welder impresses a U-shaped recess in each spacer 251. The recess can prevent displacement of the filament 13. The displacement means a vertical shift (elevation) or a horizontal shift (location) with respect to a substrate, or both. Auxiliary support members can be easily mounted every linear members (in this case, cathode mounting electrodes may be mounted respectively or in sets) even if the positions where the ends of linear members are bonded are not arranged in the same straight line as shown in FIG. 3.

Every time a spacer 251 is welded to a metal wire, it may be cut to form an independent linear auxiliary support member, using a cutter. An auxiliary support member previously cut as a small piece may be used as a spacer.

In FIGS. 1 to 3, a metal layer for a cathode mounting electrode, a cathode wire, a metal layer for bonding a spacer or damper, an anode electrode, an anode wire, and the like may be deposited in the same fabrication step and then may be patterned.

The cathode mounting electrode means an electrode for mounting a cathode filament. The cathode wire means a wire which is connected to a cathode mounting electrode and which acts as a power feeding point led out from the container (of a fluorescent display tube).

The anode electrode means the electrode having at least a portion of the upper surface (on which electrons emitted from a cathode filament impinge), on which a fluorescent substance layer is coated. The anode wire means a wire connected to an anode electrode and acting as a power feeding point led out from a container.

Figure 4A:
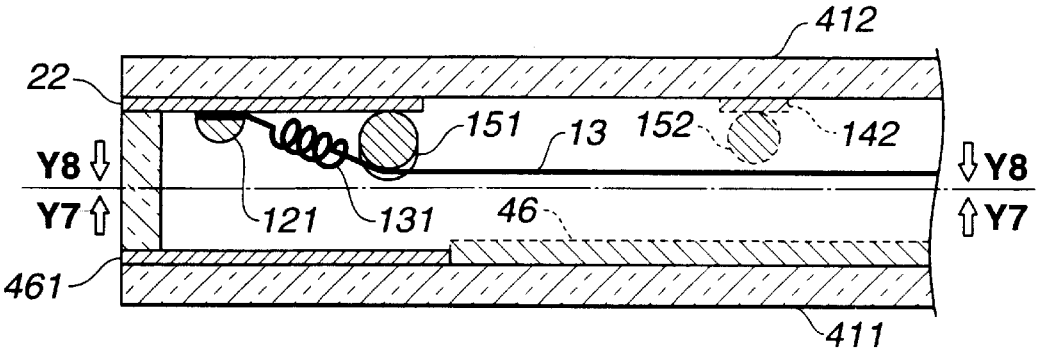
FIG. 4(*a*) is a plan view partially illustrating a fluorescent display tube according to a second embodiment of the present invention and FIGS. 4(*b*) and 4(*c*) are cross-sectional views each illustrating the same.
Figure 4B:
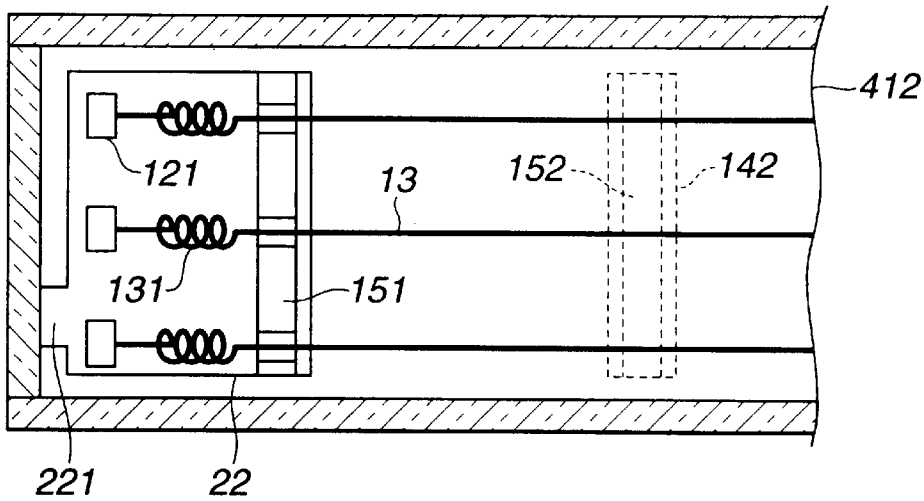
Figure 4C:
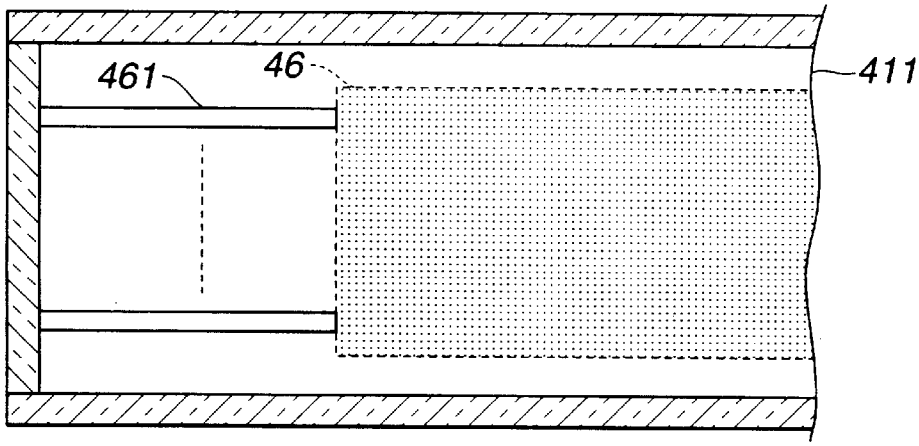

FIG. 4 is a cross-sectional view partially illustrating a fluorescent display tube according to the second embodiment of the present invention. Like numerals are attached to the same constituent elements as those in FIGS. 1 and 2. FIG. 4(*b*) is a plan view illustrating the cross section taken along the arrows Y7—Y7 of FIG. 4(*a*). FIG. 4(*c*) is a plan view illustrating the cross section taken along the arrow Y8—Y8 of FIG. 4(*a*).

Referring to FIG. 4, numeral 411 represents an anode substrate formed of an insulating material such as glass. The anode substrate 411 includes an anode 46 in which a fluorescent substance layer is coated on an anode electrode and an anode wire 461 acting as a feeding point for display signals, connected to the anode electrode and led out from a fluorescent display tube. A filament 13, a spacer 151 and a damper 152 are mounted on the back substrate 412.

As shown in FIGS. 1 to 3, the metal layers 12 and 22 (for cathode mounting electrodes) and the anode 16 are formed on the substrate 11. Hence, when the anode 16 does not have a multi-layered wiring structure (an insulating layer is not formed between an anode wire and a metal layer for a cathode mounting electrode), the wires in the anode 16 have to be led out in the direction of the arrow A or B in FIG. 1, 2, or 3. In contrast, the metal layer 22 and a cathode wire 221, shown in FIG. 4, are formed on the back substrate 412. The anode wires 461 can be led out from the anode 46 in the same direction as that of the metal 22 or in the direction the arrow A or B shown in FIG. 1, 2, or 3. The direction where an anode wire is led out can be arbitrarily chosen in accordance with the type of fluorescent display tube. In FIG. 4, the anode substrate 411 and the back substrate 412 can be assembled respectively and in parallel. This can shorten the fabrication time of a fluorescent display tube and the throughput can be improved.

An insulating layer is inserted between a NESA film and the metal layer 22 or 142 above the back substrate 412.

Figure 5A:
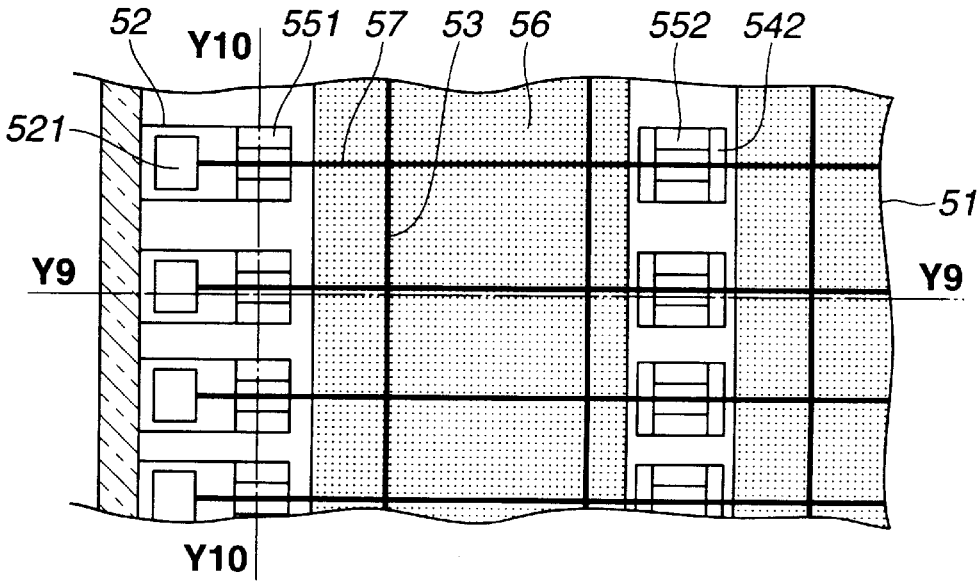
FIG. 5(*a*) is a plan view partially illustrating a fluorescent display tube according to a third embodiment of the present invention and FIGS. 5(*b*) and 5(*c*) are cross-sectional views each illustrating the same.
Figure 5B:
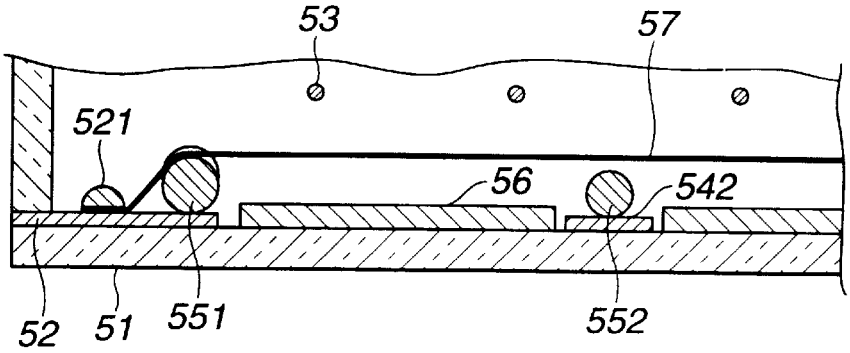
Figure 5C:
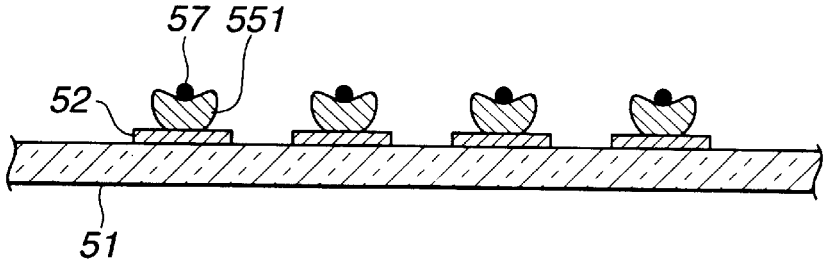

FIG. 5 shows a fluorescent display tube according to a third embodiment of the present invention. FIG. 5(*a*) is a plan view partially illustrating an insulating (e.g. glass) substrate on which a wire grid, a cathode filament, a spacer, a damper, and the like are mounted. FIG. 5(*b*) is a cross-sectional view illustrating the portion taken along the line Y9—Y9 of FIG. 5(*a*). FIG. 5(*c*) is a cross-sectional view illustrating the portion taken along the Y10—Y10 of FIG. 5(*a*).

Referring to FIG. 5, numeral 51 represents an insulating substrate such as a glass; 53 represents a cathode filament being a linear member (e.g. W or Re—W alloy); 57 represents a wire grid being a linear member (e.g. 426 alloy or stainless steel (e.g. SUS304 or SUS430)); 551 represents a spacer being an auxiliary member subsidiarily supporting the wire grid 57; and 552 represents a damper being an auxiliary member subsidiarily supporting the wire grid 57. Numeral 52 represents a metal layer (such as an aluminum thin film) for a grid mounting electrode (including a grid wire). The metal piece 521 is bonded to the metal layer 52, together with the end of the wire grid 57. The damper 552 is ultrasonic welded to the metal layer 52 (such as an aluminum thin film layer) deposited on the substrate 51. The metal piece 521 may be ultrasonic bonded to the metal layer 52.

The linear (or rod-like) aluminum spacer 551 suspends the wire grid 57 to elevate a predetermined distance from the anode 56. The damper 552 (of the same material as that of the spacer 551) is disposed to prevent the wire grid 57 from being contacted with the anode 56 due to vibration. The damper 552 is optionally disposed The spacer 551 is disposed for each wire grid 551 while the damper 542 is disposed for each wire grid 551. The metal layer 541 is disposed for each spacer while the metal layer 542 is disposed for each damper.

Figure 6A:
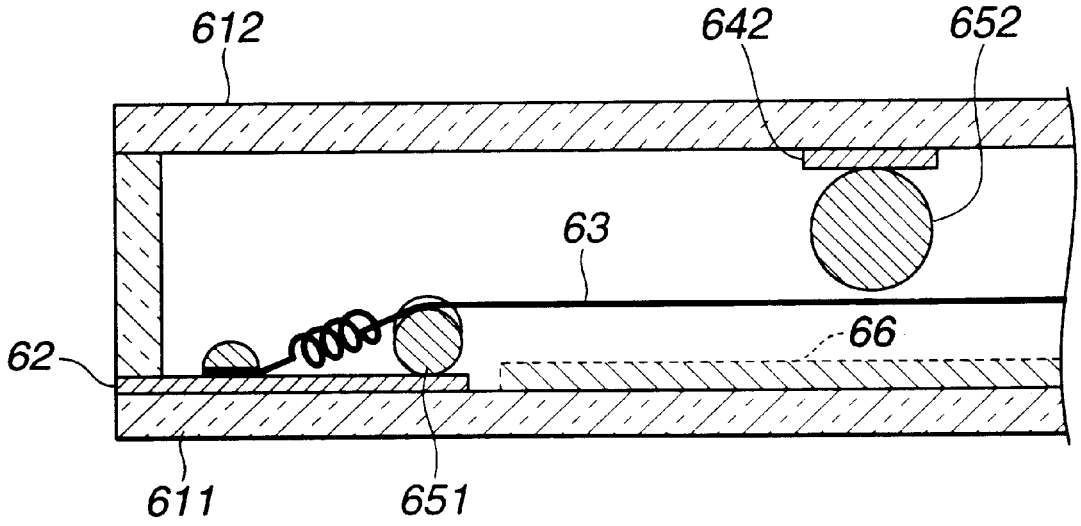
FIGS. 6(*a*) and 6(*b*) are cross-sectional views each partially illustrating a fluorescent display tube according to a fourth embodiment of the present invention.
Figure 6B:
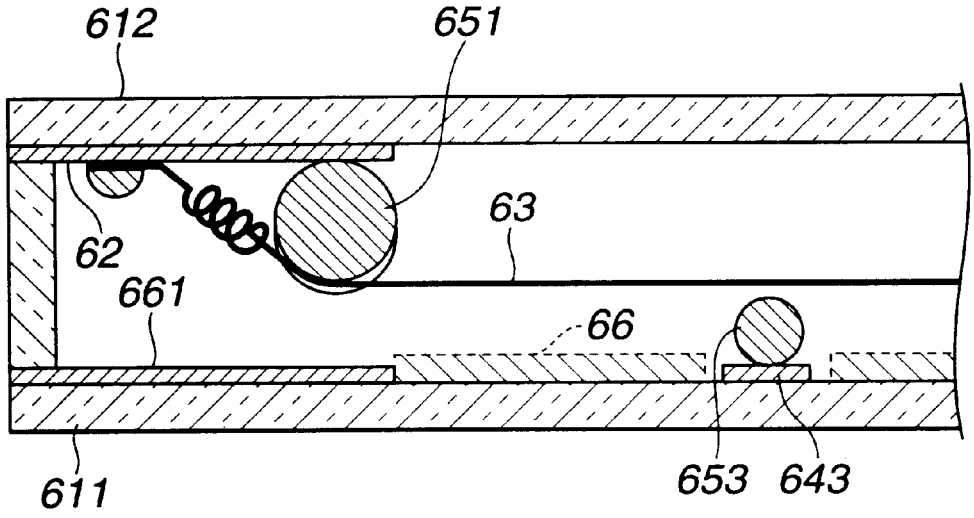
Figure 7A:
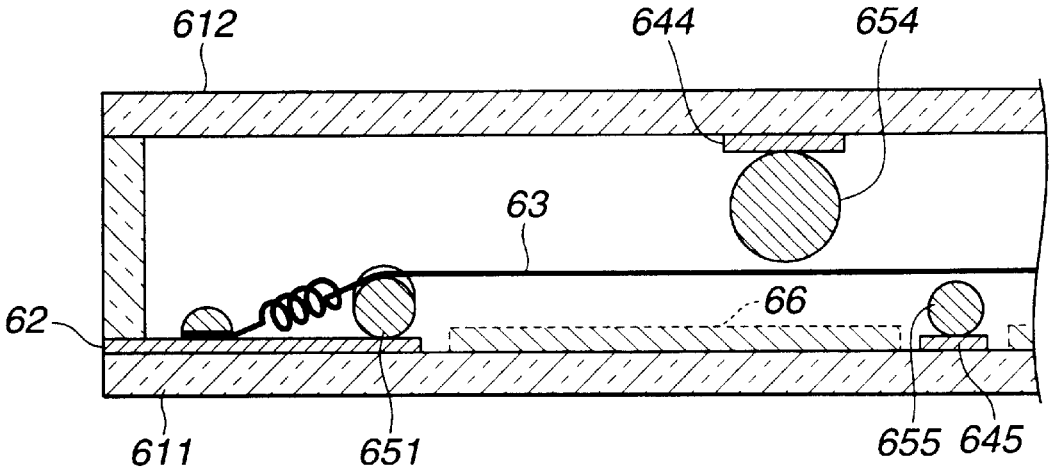
FIGS. 7(*a*) and 7(*b*) are cross-sectional views each partially illustrating the modified fluorescent display of FIG. 6.
Figure 7B:
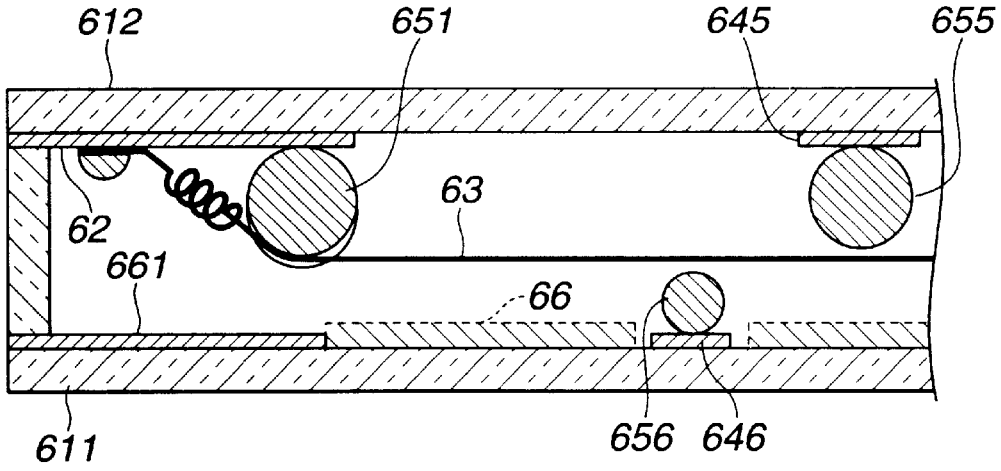

FIG. 6 is a cross sectional view partially illustrating a fluorescent display tube according to a fourth embodiment of the present invention. FIG. 7 is a cross sectional view illustrating a fluorescent display tube according to a fourth embodiment of the present invention. An arrangement of a cathode filament, a spacer, and a damper are shown.

Referring to FIG. 6(*a*), a metal layer 62 (such as an aluminum thin film) for a cathode mounting electrode (including a cathode wire), a filament 63, a spacer 651, and an anode 66 are mounted on the anode substrate 611. A damper 652 is mounted on the back substrate 612.

Referring to FIG. 6(*b*), an anode wire 661, an anode 66, and a damper 653 are disposed on the anode substrate 611. A metal layer 62, a filament 63, and a spacer 651 are disposed on the back substrate 612.

In FIG. 6(*a*), the structure in which a damper 652 is mounted on the back substrate 612 is applicable to a fluorescent display tube, which has no space for mounting the damper 652 on the anode 66.

In FIG. 6(*b*), since the metal layer 62 to which the filament 63 is mounted is disposed on the back substrate 612, the anode wire 661 extending from the anode 66 can be selectively led out in an arbitrary direction.

FIG. 7 illustrates dampers mounted on an anode substrate and a back substrate. Referring to FIG. 7(*a*), a metal layer 62, a filament 63, a spacer 651, a damper 655, and an anode 66 are disposed on the anode substrate 611. A damper 654 is mounted on the back surface 612.

Referring to FIG. 7(*b*), an anode wire 661, an anode 66, and a damper 656 are mounted on the anode substrate 611. A filament 63, a spacer 651, and a damper 656 are mounted on the back surface 612.

When the filament 63 vibrates perpendicularly to the anode 66, a damper mounted on the anode substrate or the back substrate can normally prevent the vibration. However, when the fluorescent display tube (a vehicle-mounted fluorescent luminous tube) is mounted on a vehicle largely vibrated, dampers respectively mounted on the anode substrate and the back substrate as shown in FIG. 7 can effectively prevent the vibration.

FIGS. 8 to 11 are views each illustrating a fluorescent display tube according to a fifth embodiment of the present invention. Particularly, FIGS. 8 to 11 show another arrangement of a damper for a cathode filament.

Figure 8:
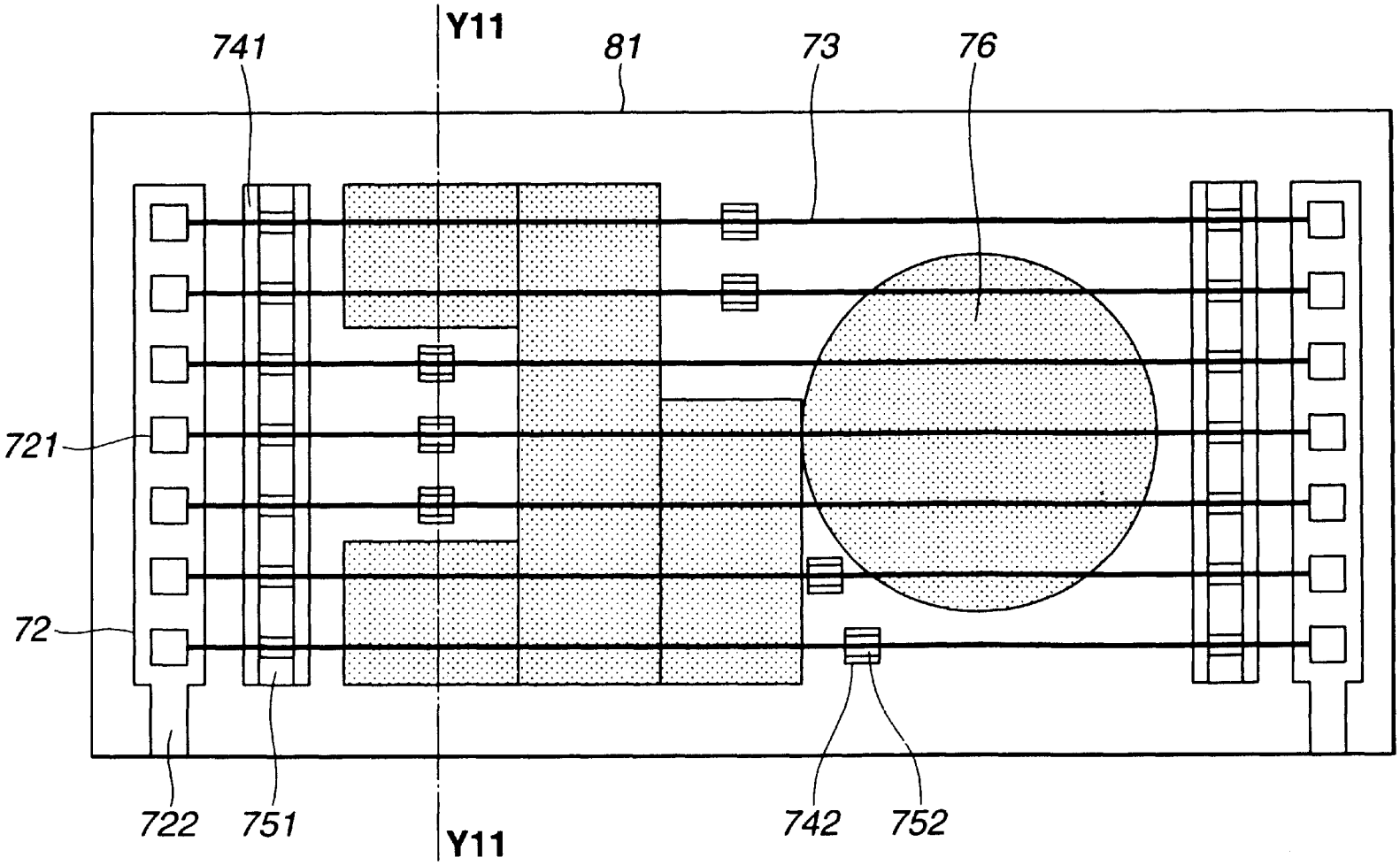
FIG. 8 is a plan view illustrating a fluorescent display tube according to a fifth embodiment of the present invention.
Figure 9A:
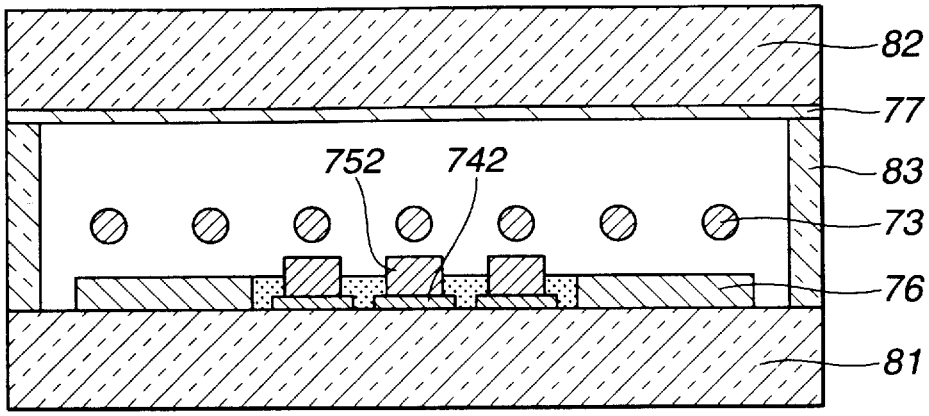
FIGS. 9(*a*) and 9(*b*) are cross-sectional views each illustrating the fluorescent display tube of FIG. 8 and FIG. 9(*c*) is a cross-sectional view illustrating a modification of the fluorescent display tube of FIG. 8.
Figure 9B:
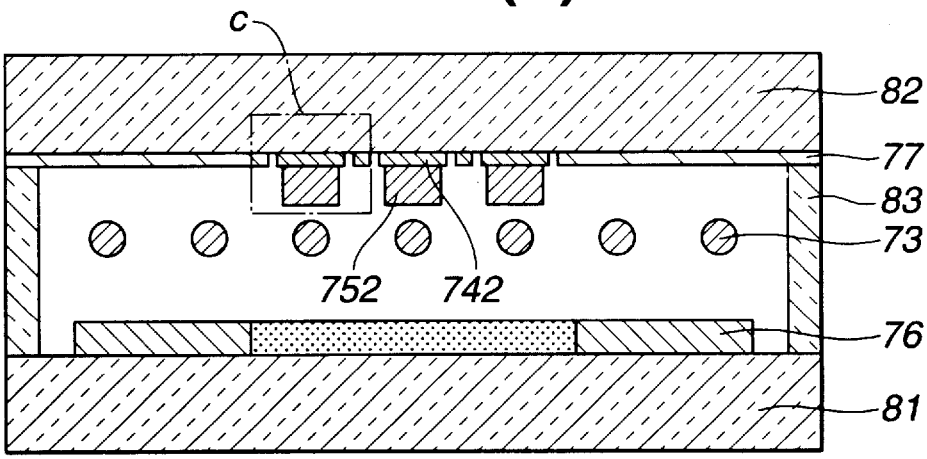
Figure 9C:
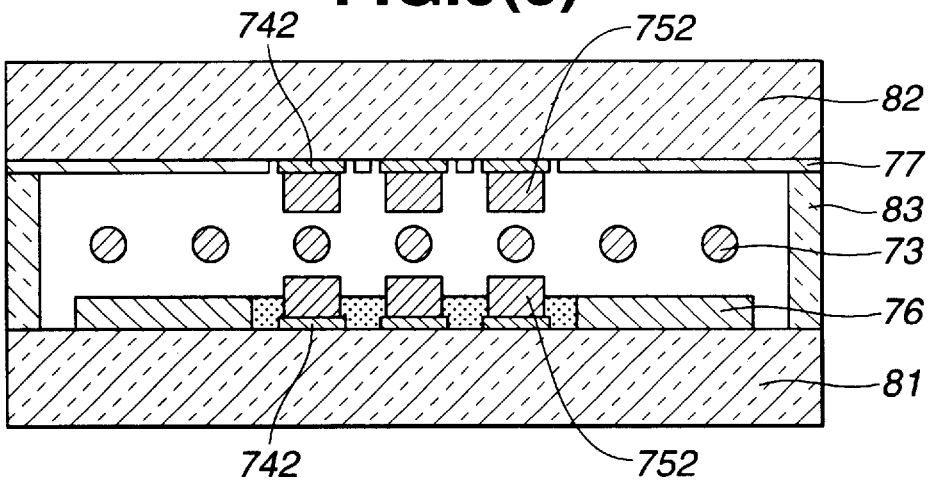

FIG. 8 is a plan view illustrating a substrate on which a cathode filament, a spacer, and a damper are mounted. FIG. 9(*a*) is a cross-sectional view illustrating the portion taken along the line Y11—Y11 of FIG. 8. FIGS. 9(*a*) and 9(*c*) are cross-sectional views each showing a modification of the structure in FIG. 9(*a*).

Referring to FIGS. 8 and 9(*a*), numerals 81 and 82 represent a substrate; 83 represents a side plate; 73 represents a cathode filament being a linear member; 72 represents a cathode mounting electrode; 722 represents a cathode wire; 751 represents a spacer being an auxiliary member for supporting a filament 73; and 752 represents a damper being an auxiliary member for supporting a filament 73. The filament 73 is a coil filament having a spring characteristic over its entire length. The coil provides a predetermined tension to a filament 73. The substrates 81 and 82 and the side plate 83 configure a hermetic container (a vacuum container) for an electron tube.

The metal piece 72 is ultrasonic welded to the metal layer 72 formed on the substrate 81, together with the end of the filament 73. A fine-wire-like (or a piece-like) spacer 751 suspends a filament 73 so as to confront the anode 76 formed of an anode electrode coated with a fluorescent substance and an anode wire while the filament 73 is spaced by a predetermined distance from the anode 76. A filament 83 may contact with another component such as anode 76 (forming an electron tube) due to vibration so as to make a short or to damage the other components. In order to overcome such a problem, a damper 752 (of the same material as that of the spacer 751) is mounted. The spacer 751 is ultrasonic welded to the metal layer 741 formed on the substrate 81. The damper 752 is ultrasonic welded to the metal layer 742 formed on the substrate 81.

The anode 76 being a luminous area (a display area) has a fixed segment pattern. For example, the square anode shown in Figure has an 8-shaped pattern. The circular anode shown Figures has a specific circular pattern.

For each filament, the damper 752 is divisionally formed on a non-luminous area (a non-display areas) other than the anode 76. In order to prevent a display failure from occurring due to a disturbance of the electron trajectory by dampers densely disposed, the dampers 752 are disposed differently on the substrate 81. In other words, all dampers are disposed scatteredly in such a way that they are not arranged in the nearly same straight line.

The damper 752 may be securely fixed to the metal layer 742 directly formed on the anode substrate. Alternately, when being formed on an anode wire, the damper 752 may be securely fixed to the metal layer 742 formed via an insulating member (an insulating layer).

A given voltage is applied to the damper 752 via the conductor lead out from the metal layer 742.

Referring to FIGS. 8 and 9(*a*), the distance between the filament 73 and the substrate 81 is 0.85 mm. The damper is formed of a wire of a diameter of 0.5 mm. In the ultrasonic bonding, the damper is at an elevation of 0.35 mm to 0.4 mm. The damper can be arbitrarily elevated in accordance with the wire diameter and the ultrasonic bonding conditions.

The conventional linear damper is suitable for graphic displaying but unsuitable for displaying a fixed pattern. In contrast, in the embodiment shown in FIGS. 8 and 9(*a*), dampers 752 can be divisionally disposed at arbitrary positions (outside display areas) underneath the filament 73. This arrangement is suitable for a damper for displaying a fixed pattern.

Each of FIGS. 9(*b*) and 9(*c*) shows a modification of the arrangement of dampers 752 (each being an auxiliary support member) shown in FIG. 9(*a*). Like numerals are attached to the same constituent elements as those in FIG. 9(*a*).

In FIG. 9(*b*), dampers 752 confront the anode substrate 8 on which the anode 76 is formed and are formed on the cathode substrate 82 on which a cathode including a cathode electrode and a cathode wire (not shown) is formed.

In FIG. 9(*c*), the dampers 752 are respectively formed on the anode substrate 81 including the anode 76 and on the cathode substrate 82 including the cathode. The cathode may be formed on the anode substrate 81 including the anode 76.

Figure 10A:
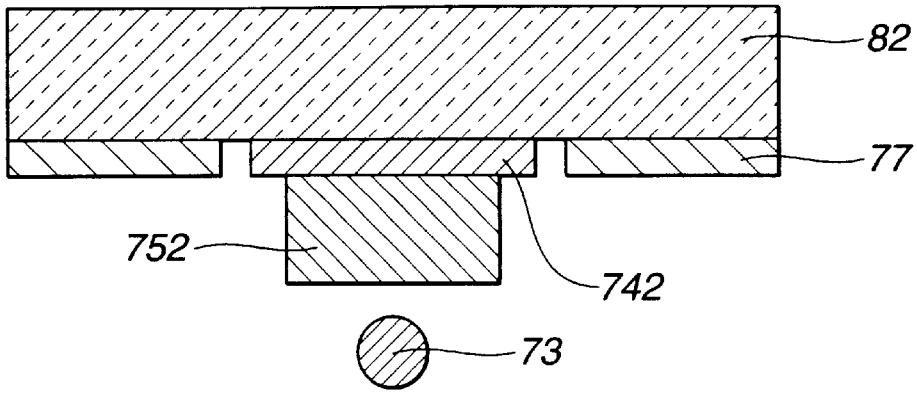
FIG. 10(*a*) is a partially enlarged cross-sectional view illustrating a modification of the fluorescent display tube of FIG. 8 and FIGS. 10(*b*) and 10(*c*) are plan view each illustrating the same.
Figure 10B:
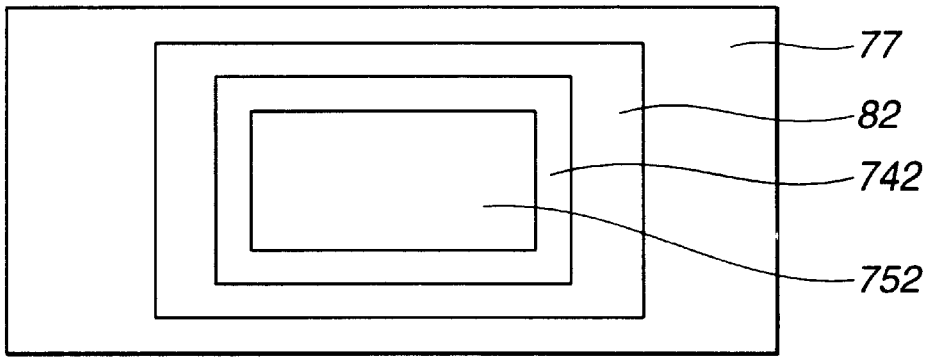
Figure 10C:
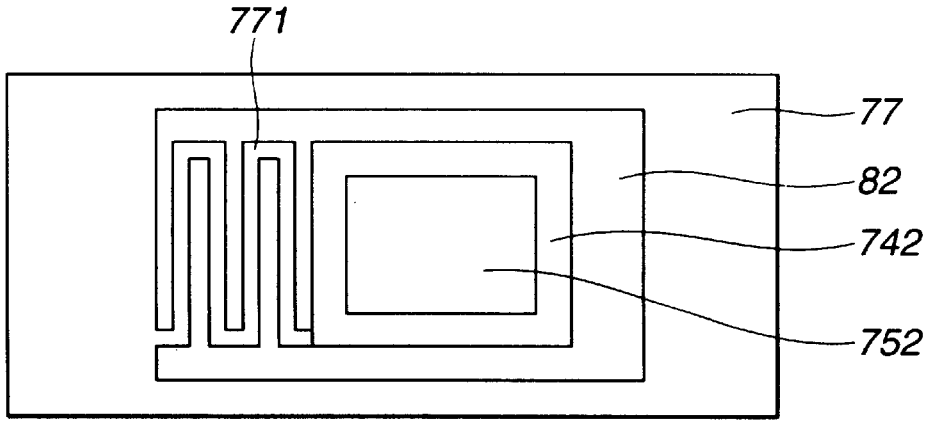
Figure 11A:
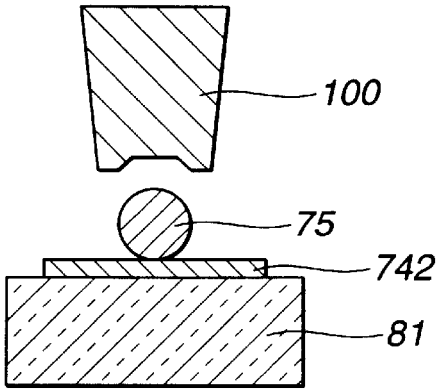
FIGS. 11(*a*), 11(*b*), 11(*c*), 11(*d*), 11(*d*), and 11(*e*) are diagrams each showing the method of manufacturing the fluorescent display tube of FIG. 8.
Figure 11D:
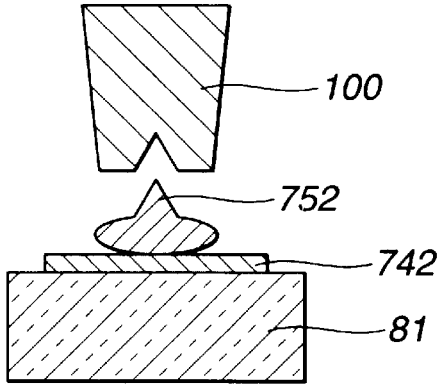
Figure 11B:
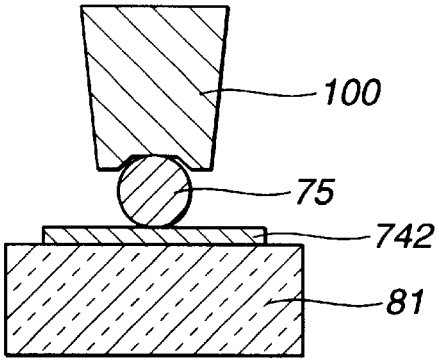
Figure 11E:
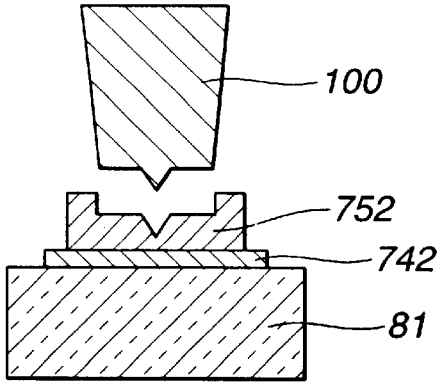
Figure 11C:
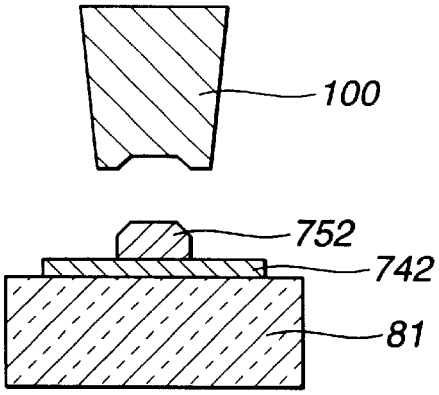
Figure 12A:
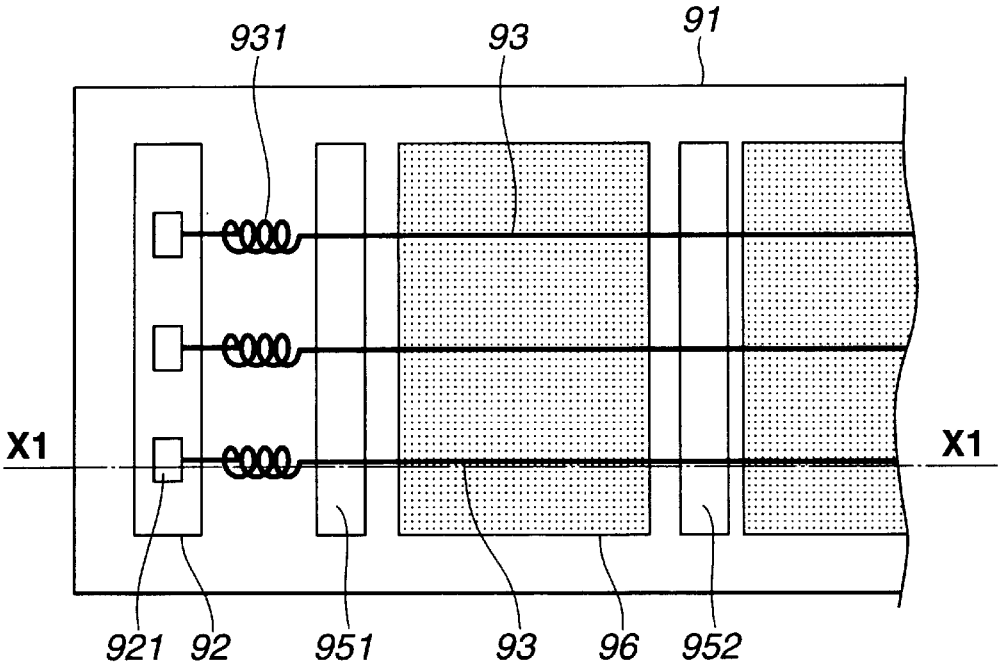
FIG.12(a) PRIOR ART
FIG. 12(*a*) is a plan view partially illustrating a conventional fluorescent tube and FIGS. 12(*b*) and 12(*c*) are cross-sectional views each illustrating the same.
Figure 12B:
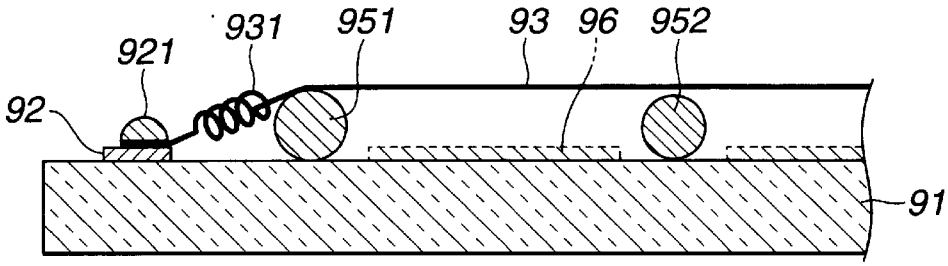
FIG.12(b) PRIOR ART
Figure 12C:
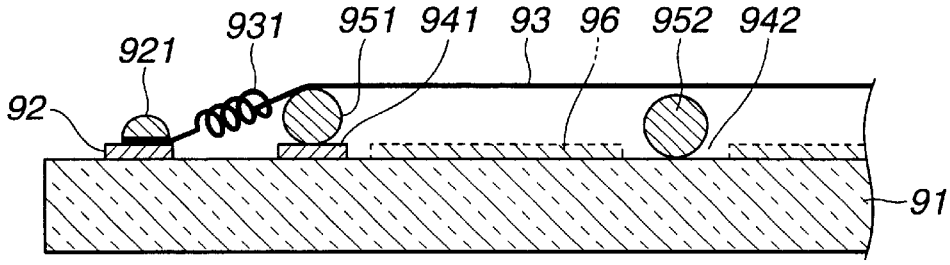
FIG.12(c) PRIOR ART
Figure 13A:
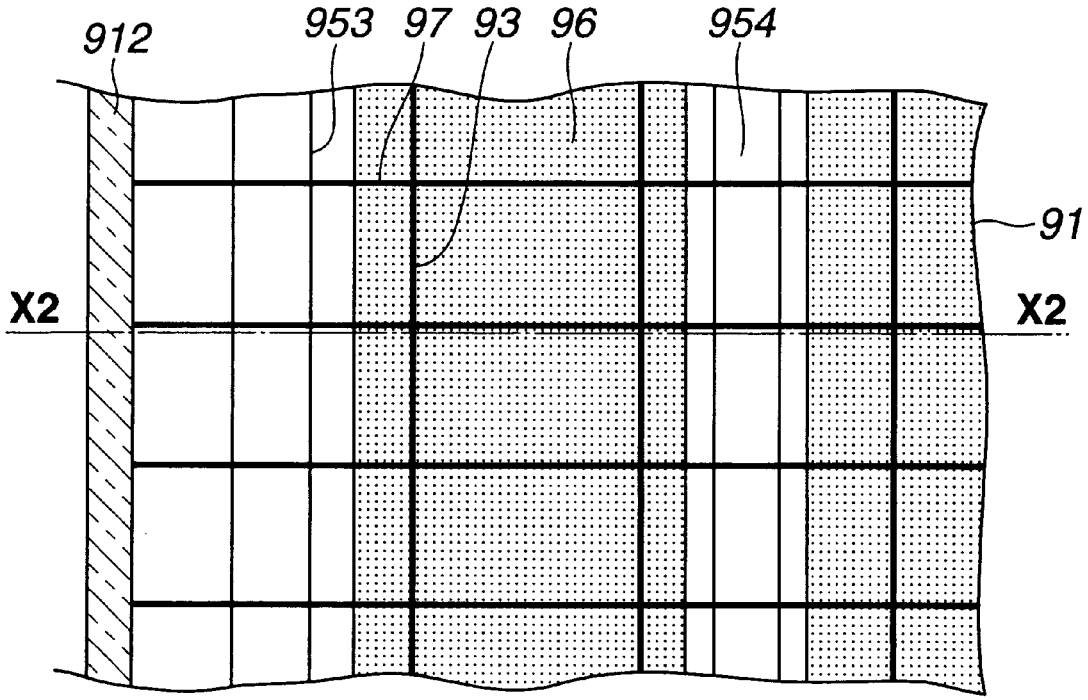
FIG.13(a) PRIOR ART
FIG. 13(*a*) is a plan view partially illustrating a conventional fluorescent tube and FIG. 13(*b*) is a cross-sectional view partially illustrating the same.
Figure 13B:
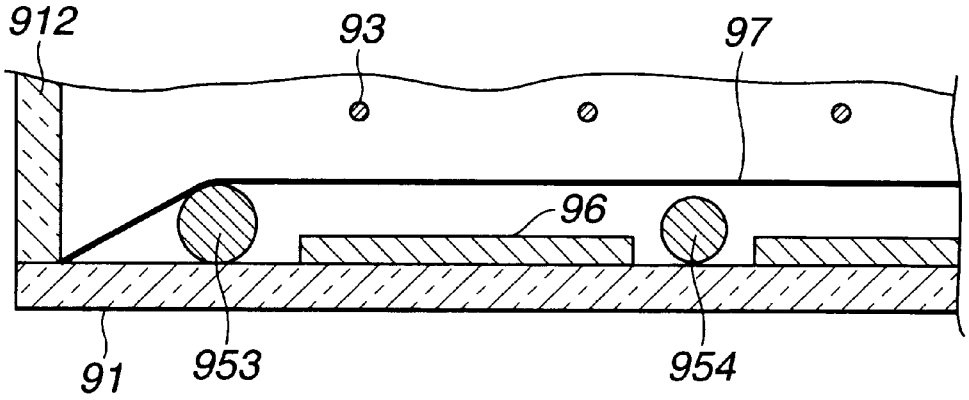
FIG.13(b) PRIOR ART

FIG. 10(*a*) is a partially enlarged cross-sectional view illustrating the region C as shown in FIG. 9(*b*). FIG. 10(*b*) is a plan view illustrating the region C of FIG. 10(*a*). FIG. 10(*c*) shows a modification of the structure in FIG. 10(*b*). Like numerals are attached to the same constituent elements as those of FIG. 9(*b*).

In FIGS. 10(*a*) and 10(*b*), numeral 82 represents a cathode substrate confronting the anode substrate 81 (when a cathode is formed on the anode substrate 81, the cathode substrate is called a front substrate). Numeral 77 represents a back diffusion substrate.

In FIG. 10(*a*), light emitted from the anode 76 is observed through the cathode substrate 82. This structure is called a front luminous-type fluorescent display tube. In the front-luminous-type fluorescent display tube, a transparent conductive film 77 for charge-up protection formed of ITO is formed on the inner surface of a cathode substrate. When the light emitted from the anode 76 is observed through the anode substrate 81, the conductive film 77 may be of non-transparent (opaque).

The metal layer 742, separated electrically from the transparent conductive film 77, is formed. In FIG. 10(*b*), the transparent conductive layer 77 is removed in a frame pattern. The metal layer 742 is formed within the removed region (the portion where the transparent conductive film 77 is not formed).

FIG. 10(*c*) shows a modification of the region of FIG. 10(*b*). A potential is applied to the damper 752.

Referring to FIG. 10(*c*), the metal layer 742 is connected to the transparent conductive film 77 via the resistance pattern 771 of the transparent conductive layer 77. Using the transparent conductive film 77 and the same potential power source, a predetermined potential is applied to the damper 752 through the resistance of the resistance pattern 771.

Referring to FIG. 10, the distance between the filament 73 and the transparent conductive film 77 overlying the substrate 82 is 0.35 mm to 0.4 mm. The damper is formed of a wire having a diameter of 0.3 mm. After the ultrasonic bonding, the height of a damper is 0.2 mm to 0.25 mm. The height of a damper depends on the wire diameter and ultrasonic bonding conditions.

FIG. 11 shows the method of forming the damper 752 in FIGS. 8 and 9(*a*). Like numerals are attached to the same constituent elements as those in FIGS. 8 to 10. This is applicable for the method of forming the spacer 751.

Each of FIGS. 11(*a*), 11(*b*), and 11(*c*) shows an example of the method of forming the damper 752. Each of FIGS. 11(*d*) and 11(*e*) shows a modification of the method of forming the damper 752.

In order to weld the metal layer 742 to the damper 752, the bonding wire 75 is first placed on the metal layer 742 as shown in FIG. 11(*a*).

Next, as shown in FIG. 11(*b*), the edge of wedge tool 100 of an ultrasonic welder is pressed against the damper 752 at the position where the filament 73 contacts with the damper 752 during vibration. The edge of the wedge tool 100 has a groove in a predetermined shape. By applying ultrasonic waves by the wedge tool 100, the damper 752, formed of the bonding wire 75, is ultrasonic bonded to the metal layer 742. In the welding, a (trapezoidal) protrusion is formed on the surface of the damper 752, in accordance with the inner shape of the wedge tool 100.

Finally, the wedge tool 100 is separated from the damper 752, as shown in FIG. 11(*c*).

As shown in FIG. 11(*d*), the wedge tool 100 of an ultrasonic welder is pressed against the damper 752 to emboss a protrusion on the surface of the damper 752.

Suspending a linear member so as to confront the protrusion allows the contact area to be minimized while the linear member is vibrating.

Moreover, the damper with a protrusion can effectively reduce variations in divergence of electrons emitted from the filament 13.

As shown in FIG. 11(*e*), the wedge tool 100 of an ultrasonic welder has a wedge-like protrusion. The wedge tool 100 is pressed against the damper 752 to form a two-stepped recess in the surface of the damper 752

A linear member suspended in the recess does not move horizontally. Particularly, this arrangement is effectively used as a spacer.

The positional precision of the damper 752 is −0.005 mm to +0.005 mm. The mounting position can be controlled with high precision.

In each embodiment, the spacer, the damper, and the metal layer to which they are mounted are formed of aluminum. The above-mentioned constituent elements may be other welding (bonding)-prone metal materials including copper, gold, nickel, silver, niobium, vanadium, and platinum. In view of the bonding strength, the spacer, the damper, and the metal layer for mounting them are preferably formed of the same sort of material or may be formed of different sorts of metals. Elements of the same material can be welded together with the strongest bonding strength. Aluminum and aluminum alloy are listed as the same sort of metal.

In this embodiment, a linear wire for welding is used as an auxiliary support member. After the linear wire is bonded to a metal layer, the bonded element is cut to form auxiliary support members. In other words, a welding (or bonding) wire is ultrasonic welded to a metal layer. Then the welded element is cut. However, a metal piece may be used in place of the wire. That is, an auxiliary support member may be ultrasonic welded (or bonded) to the metal layer.

In each of the embodiments, a metal thin film is used to mount the spacer and the damper. However, a thick film (formed by the screen printing process) containing at least metal components may be used.

The auxiliary support member can be welded through laser or resistance heating. However, such heating may damage an aluminum thin film. On the other hand, it has been ascertained that ultrasonic welding does not substantially cause such a problem. For that reason, it is useful to bond a linear member such as a filament to a metal thin film, using the ultrasonic welding.

In each of the embodiments, spacers or dampers, each having a circular cross section, have been described. However, spacers or dampers each which has a polygonal cross section including a square cross section, a trapezoidal cross section, a pentagonal cross section, or the like may be used. Spacer or dampers may be plate-like members. A spacer or damper, which has a flat bottom surface (a contact surface to a metal layer), is more stable. In such a spacer or damper, surfaces other than the bottom surface may be curved.

In each of the embodiments, an insulating substrate such as glass has been used as a base substrate. However, a conductive substrate on which an insulating layer is formed may be used as a base substrate.

In each of the embodiments, linear members such as a cathode filament and a wire grid have been described. However, a linear spacer (a filament linear spacer or a wire grid linear spacer) or a linear damper (a filament linear damper, or a wire grid linear damper), formed of a tungsten wire, a molybdenum wire, or a stainless steel wire subsidiarily supporting the linear members, may be used.

The linear spacer or the linear damper may be applicable without any change, in place of the linear member 57 in FIG. 5.

In more detail, when being used as a linear spacer, the linear member 57 must be in contact with the cathode filament 53. When being used as a linear damper, the linear member 57 may be in contact with or in no contact with the cathode filament 53. In such an arrangement, the linear member 57 has to be disposed at the position where the cathode filament 53 contacts with the anode during vibration. The metal layer 52 is not led out because it requires no potential.

Similarly, a linear getter can be used.

The linear getter may be substituted for the linear member 57 in FIG. 5, without other changes.

In more detail, the linear getter may be disposed in a non-luminous area (non-display area) other than luminous areas (display areas) including anodes 56. Among getters, there are an evaporation-type wire getter and a non-evaporation-type wire getter.

The evaporation-type wire getter is integrally mounted on a metal wire, for example, in a groove formed in a metal wire. The evaporation-type wire getter is selectively heated by radiating laser beam or infrared rays. Thus, the getter evaporates so as to form a getter film over an inner surface of the container of an electron tube. The getter film gains a gas absorption capability. Alternately, the getter is heated by conducting a current through the getter electrode. The getter material may be evaporated to form a getter film over an inner surface of the container of an electron tube.

Main contents of Ze, Ti, and Ta may be used for a non-evaporation-type wire getter. For example, a linear member formed of a getter wire including Zr—Ar alloy, Zr—Fe alloy, Zr—Ni alloy, Zr—Nb—Fe alloy, Zr—Ti—Fe alloy, or Zr—V—Fe alloy may be used. A non-evaporation-type wire getter may be integrally formed on other metal wire. The non-evaporation-type wire getter is selectively heated to an activation temperature, by radiating a laser beam or infrared rays. Thus, a gas absorption capability will develop. Alternately, the getter may be wholly heated to an activation temperature by energizing via the getter electrode, whereby a gas absorption capability can be obtained.

In each of the embodiments, an example of forming a metal layer and an auxiliary support member on an anode or cathode substrate (being a base substrate forming a container) has been described. However, the metal layer and the auxiliary support member may be formed on the side plate forming a container. Moreover, the metal layer and the auxiliary support member may be formed, via an insulating member, on components contained in a container and forming an electron tube. The metal layer and the auxiliary support member may be respectively mounted on the components.

A fluorescent display tube has been described in each of the embodiments. However, the present invention may be applicable for an electron tube that includes a linear member (e.g. a cathode filament or a wire grid), a wire getter, and a linear auxiliary support member, such as a linear spacer or a linear damper, for subsidiarily supporting a linear member (e.g. a tungsten wire, a molybdenum wire, or a stainless steel wire). For example, a display tube (e.g. a cathode-ray tube), a discharge tube (e.g. a thermal cathode discharge tube), a vacuum tube, a print head fluorescent luminous tube utilizing the principle of a fluorescent display tube, and a fluorescent display luminous tube for a large screen display device are listed as the electron tube.

In each of the embodiments, a hermetic container is formed of an anode substrate, and a front substrate or a cathode substrate (a second substrate) confronting the anode substrate. However, a hermetic container may be three substrates or more.

For example, a hermetic container is fabricated by juxtaposing a cathode substrate as well as a first anode substrate and a second anode substrate, on both the sides of the cathode substrate and then sealing the peripheral portions of the container with an adhesive agent.

In this case, cathode filaments are disposed on both the surfaces of a cathode substrate.

An anode electrode having the surface confronting a cathode filament, on which a fluorescent substance is coated, and an anode wire may be disposed on the surface of each of the first and second anode substrates.

An auxiliary member welded to each of metal layers formed on both the surfaces of a cathode substrate acts as a spacer for defining the elevation of a cathode filament from the cathode substrate or a damper for making contact with a cathode filament and blocking the vibration thereof.

Similarly, a hermetic container is fabricated by juxtaposing a front substrate an anode substrate and then sealing the peripheral portions of them with an adhesive agent. A control electrode substrate through which electrons radiated from a cathode filament pass selectively is disposed in the middle of the hermetic container.

In such a case, an anode electrode which has the surface confronting a cathode filament, on which a fluorescent substance is coated, and an anode wire are formed on the anode substrate.

Moreover, a cathode filament is mounted on the front substrate side of a control electrode substrate. Plural through-holes, through which electrons pass, are formed at the positions corresponding to respective fluorescent substances. Control electrodes are formed on one surface or both the surfaces of the control electrode substrate.

A metal layer is formed on the surface of the control electrode substrate, which confronts a cathode filament. An auxiliary member is welded to the metal layer. Thus, this structure acts as a spacer for defining the elevation of a cathode filament from the control electrode substrate or a damper for making contact with a cathode filament and blocking the vibration thereof.

The side plate is not required because sealing can be made with only the adhesive agent such as fritted glass when the gap between substrates is narrow and supporting members such as pillars are inside a hermetic container.

Diffusion bonding or friction pressure bonding (corresponding to ultrasonic bonding or ultrasonic wire bonding), and solid-phase bonding (ultrasonic pressure bonding) are included as the welding (ultrasonic welding) for the present invention.

In the electron tube (such as a fluorescent display tube) according to the present invention, an auxiliary support member (such as a linear spacer, a linear damper or a linear getter) subsidiarily supporting a linear member (such as a cathode filament of a wire grid) is securely bonded to a substrate, without using a conventional adhesive agent such as a fitted glass or a conductive paste. By doing so, the auxiliary support member does not become detached and displaced because of the heating after the auxiliary support member mounting step. Moreover, unlike the prior art, because an adhesive agent is not used, gas, which deteriorates the vacuum degree, is not substantially emitted in an electron tube such as a fluorescent display tube. According to the present invention, the thin or thick film metal layer to which an auxiliary support member is mounted is formed on a substrate by a known vacuum vapor deposition or screen printing method without using any adhesive agent. Hence, gas is not substantially emitted inside a container.

Moreover, according to the present invention, because an auxiliary support member is securely fixed to a metal layer formed on a substrate by ultrasonic welding, it is not required to meet the thermal expansion coefficient of the support member to that of the substrate.

When the recess for preventing a linear member from being displaced is formed while an auxiliary support member is being ultrasonic welded, it is not required to prepare a spacer or damper with a previously-formed recess. Hence, the spacer or damper fabrication costs can be reduced. The depth of the recess can be changed by changing the shape of the inner surface of the wedge tool of an ultrasonic welder. Hence, the elevation of a linear member can be easily changed. This feature is applicable for a spacer or damper with a protrusion.

According to the present invention, when the spacer for a cathode filament is used as power feeding means, the coil, providing tension to the cathode filament and being disposed between an auxiliary support member and a cathode filament fixed portion, is not heated. Hence, the coil not heated does not evaporate the electron emitter such as carbonate coated on the coil so as to contaminate the fluorescent substance. The spring characteristic of the coil is not deteriorated. Moreover, the coil does not wastefully consume the electric power. Displaying is not deteriorated because the coil is not heated in red. This feature is applicable for the straight cathode filament.

Particularly, the structure where a partial coil portion of a linear member is disposed between a spacer and the fixing portion of the linear member is preferable.

For example, in order to manufacture a fluorescent display tube, a spacer or damper bonding metal layer can be formed and patterned by the step of fabricating either a cathode mounting electrode and/or a cathode wire or an anode electrode and/or a anode wire. Thus, a fluorescent display tube can be easily fabricated.

Either a cathode mounting electrode and a spacer or a damper bonding metal layer and a damper can be bonded together through ultrasonic welding in the same fabrication step. Moreover, a metal layer for a cathode mounting electrode can be ultrasonic welded with a cathode filament. This feature facilitates the fabrication of a fluorescent display tube.

What is claimed is:

1. An electron tube comprising:

a hermetic container having a first substrate and a second substrate confronting said first substrate;

a plurality of linear members disposed in said hermetic container;

metal layers formed at both side ends of said first substrate of said hermetic container; and metal auxiliary members disposed between said linear members and said metal layers and welded to each of said metal layers for supporting said linear members;

wherein said metal layers comprise linear member mounting electrode.

2. An electron tube comprising:

a hermetic container having a first substrate and a second substrate confronting said first substrate;

a plurality of linear members disposed in said hermetic container;

metal layers formed at both side ends of said first substrate of said hermetic container; and metal auxiliary members disposed between said linear members and said metal layers and welded to each of said metal layers for supporting said linear members;

wherein said auxiliary members are disposed independently for each linear member.

3. An electron tube comprising:

a hermetic container having a first substrate and a second substrate confronting said first substrate;

a plurality of linear members disposed in said hermetic container;

metal layers formed at both side ends of said first substrate of said hermetic container; and metal auxiliary members disposed between said linear members and said metal layers and welded to each of said metal layers for supporting said linear members;

wherein each of said auxiliary members has a recessed or a protrusion at a position where each of said auxiliary members confronts said linear members.

4. The electron tube defined in claim 3, wherein each of said linear members comprises a cathode filament; and wherein each of said auxiliary members comprises a spacer for the cathode filament; at least one set of said spacers being disposed between said metal layers and one of said linear members.

5. The electron tube defined in claim 3, wherein each of said linear members comprises a cathode filament; and wherein each of said auxiliary members comprises a damper for the cathode filament; said damper being disposed between said metal layers and one of said linear members.

6. The electron tube defined in claim 3, wherein each of said linear members comprises a cathode filament; and wherein each of said auxiliary members comprises a spacer and a damper for a the cathode filament; said spacers being disposed between said metal layers and one of said linear members said damper being disposed between said spacers.

7. The electron tube defined in claim 3, wherein each of said linear members comprises a wire grid; and wherein each of said auxiliary members comprises a spacer for said wire grid; said spacers being disposed between said metal layers and one of said linear members.

8. The electron tube defined in claim 3, wherein each of said linear members comprises a grid wire; and wherein each of said auxiliary members comprises a damper for said wire grid: said damper being disposed between metal layers and one of said linear members.

9. The electron tube defined in claim 3, wherein said welding is ultrasonic welding.

10. The electron tube defined in claim 3, wherein said metal layer and said auxiliary members are made of the same metal material.

11. The electron tube defined in claim 3, wherein said metal layer comprises a thin film layer.

12. The electron tube defined in claim 3, wherein said linear member has partially or wholly a spring for providing tension.

13. The electron tube defined in claim 3, wherein said linear member comprises a linear spacer or a linear damper or a linear getter.

14. The electron tube defined in claim 3, wherein said electron tube is a fluorescent luminous tube.

15. A method of manufacturing an electron tube having a hermetic container containing a first substrate and a second substrate confronting said first substrate, comprising the steps of:

forming metal layers at both side ends of said first substrate of said hermetic container;

feeding a bonding wire as a metal auxiliary member for supporting linear members above each of said metal layers;

bonding said metal auxiliary member to said metal layers through ultrasonic welding;

cutting said metal auxiliary member into a predetermined length; and disposing said linear members so as to confront said auxiliary member.

16. The electron tube manufacturing method defined in claim 15, further comprising the steps of:

forming an electrode on said first substrate; and simultaneously forming said metal layer, together with forming the electrode on said electrode.

17. The electron tube manufacturing method defined in claim 16, wherein said electrode comprises an anode electrode.

18. The electron tube manufacturing method defined in claim 16, wherein said cathode electrode comprises a cathode mounting electrode.

19. The electrode tube manufacturing method defined in claim 16, wherein said electron tube comprises a fluorescent luminous tube.

20. An electron tube comprising:

a hermetic container having a first substrate and a second substrate confronting said first substrate;

a plurality of linear members disposed in said hermetic container;

metal layers formed at both side ends of said first substrate of said hermetic container;

metal auxiliary members disposed between said linear members and said metal layers and welded to each of said metal layers for supporting said metal layers and said linear members;

wherein said auxiliary members are made of a wire of aluminum or aluminum alloy and said metal layers are made of aluminum and aluminum alloy.

21. An electron tube comprising:

a hermetic container having a first substrate and a second substrate confronting said first substrate;

first metal layers formed on said first substrate having metal auxiliary members welded to each of said first metal layers to form first dampers on said first substrate inside said hermetic container;

second metal layers formed on said second substrate having metal auxiliary members welded to each of said second metal layers to form second dampers on said second substrate inside said hermetic container; and a plurality of linear members disposed between said first and second dampers inside said hermetic container.

22. An electron tube comprising:

a hermetic container having a first substrate and a second substrate confronting said first substrate;

a plurality of linear members disposed between said first and second substrates inside said hermetic container; and metal layers formed on said first substrate having metal auxiliary members welded to each of said metal layers to form dampers for checking vibration in said linear members on said first substrate, said dampers being disposed at a predetermined position along said linear members to be offset with respect to each of said linear members.

23. An electron tube comprising:

a hermetic container having a first substrate and a second substrate confronting said first substrate;

a plurality of linear members disposed between said first and second substrates inside said hermetic container;

conductive films formed on said first substrate for charge-up protection, said conductive films being in a shape of a frame, each frame having a void portion free from said conductive films inside said frame; and metal layers formed on said first substrate having metal auxiliary members welded to each of said metal layers to form dampers for checking vibration in said linear members on said first substrate, said metal layers being disposed within each void portion of said conductive films to electrically separate said metal layers from said conductive films.

24. An electron tube comprising:

a hermetic container having a first substrate and a second substrate confronting said first substrate;

a plurality of linear members disposed between said first and second substrates inside said hermetic container;

conductive films formed on said first substrate for charge-up protection, said conductive films being in a shape of a frame, each frame having a void portion free from said conductive films inside said frame and a resistant pattern; and metal layers formed on said first substrate having metal auxiliary members welded to each of said metal layers to form dampers for checking vibration in said linear members on said first substrate, said metal layers being disposed within each void portion of said conductive films and connected to said conductive films by said resistant pattern to apply electric potential to said metal layers.

* * * * *